US007201640B2

(12) United States Patent
Nakamura et al.

(10) Patent No.: US 7,201,640 B2
(45) Date of Patent: Apr. 10, 2007

(54) METHOD OF SUCKING WATER AND WATER SUCKING DEVICE

(75) Inventors: Yoshio Nakamura, Nagano (JP); Mitsue Ogawa, Nagano (JP); Kenji Hashizume, Nagano (JP)

(73) Assignee: Fujikoshi Machinery Corp., Nagano-shi (JP)

( * ) Notice: Subject to any disclaimer, the term of this patent is extended or adjusted under 35 U.S.C. 154(b) by 0 days.

(21) Appl. No.: 11/093,426

(22) Filed: Mar. 30, 2005

(65) Prior Publication Data

US 2005/0221725 A1 Oct. 6, 2005

(30) Foreign Application Priority Data

Mar. 31, 2004 (JP) ..... 2004-104535
Feb. 28, 2005 (JP) ..... 2005-053148

(51) Int. Cl.
*B24B 1/00* (2006.01)

(52) U.S. Cl. ..... 451/41; 451/57; 451/285; 451/286; 451/287; 451/288; 451/289

(58) Field of Classification Search ..... 451/41, 451/57, 285, 286, 287, 288, 289
See application file for complete search history.

(56) References Cited

U.S. PATENT DOCUMENTS 4,193,226 A * 3/1980 Gill et al. ..... 451/276
4,521,995 A 6/1985 Sekiya
5,618,354 A * 4/1997 Lofaro ..... 134/25.4
5,908,347 A * 6/1999 Nakajima et al. ..... 451/5
6,193,586 B1 2/2001 Park et al.

FOREIGN PATENT DOCUMENTS

JP 56-164549 12/1981
JP 2003-11056 1/2003

* cited by examiner

*Primary Examiner*—Joseph J. Hail, III
*Assistant Examiner*—Shantese McDonald
(74) *Attorney, Agent, or Firm*—Jordan and Hamburg LLP

(57) ABSTRACT

The method of sucking water is capable of easily removing excess water included in a backing member adhered on a plate of a polishing apparatus. In the method, the excess water is removed from the backing member by the steps of: pressing a water absorbing member onto a holding surface of the backing member, on which the work piece is adhered and held, so as to absorb the excess water from the backing member; and sucking the excess water absorbed by the water absorbing member.

12 Claims, 8 Drawing Sheets

METHOD OF SUCKING WATER AND WATER SUCKING DEVICE

BACKGROUND OF THE INVENTION

The present invention relates to a method of sucking water and a water sucking device, more precisely relates to a method of sucking water and a water sucking device, which are capable of sucking excess water, which is used for adhering a work piece to be polished and which is included in a backing member adhered on one side face of a plate of a polishing apparatus, to remove from the backing member.

A work piece, e.g., a wafer for producing semiconductor devices, is polished by, for example, a polishing apparatus shown in FIG. 11. In the polishing apparatus shown in FIG. 11, a polishing plate 100, on which a polishing cloth 102 is adhered, is rotated in a prescribed direction. A top ring 104 is rotated in a prescribed direction and moved to and away from the polishing plate 100. A ceramic plate 106 is assembled in a head section of the top ring 104, and a wafer W is held by the plate 106 and pressed onto the polishing cloth 102 so as to polish the wafer W.

As shown in FIG. 12, a backing member 108, which is made of, for example, sheet-shaped resin foam and which is adhered on one side face of the plate 106, includes water, and the wafer W is held on the plate 106 by surface tension of the water.

These days, large and thin wafers W are used, and high polishing accuracy is required.

However, as shown in FIG. 12, a center part of a surface of the polished wafer W, which has been adhered by surface tension of the water included in the backing member adhered on the one side face of the plate 106, is apt to be thinner than an outer edge part thereof.

Namely, the center part of the surface of the polished wafer W is apt to be excessively polished, so that the wafer W is formed into a concave shape. The reason for forming the concave shape will be explained.

When the wafer W is adhered on the backing member 108 excessively including water and pressed onto the polishing cloth 102 of the polishing plate 100 so as to polish the wafer W, the backing member 108 is pressed by the outer edge part of the wafer W so that the outer edge part of the wafer W seals a space therebetween (see FIG. 13). Therefore, the excess water included in the backing member 108 cannot move to outside of the wafer W, so that the excess water concentrates to the center part of the wafer W.

At that time, temperature of the water included in the backing member 108 is risen by frictional heat caused by polishing, and a center part of the backing member 108, which corresponds to the center part of the wafer W, is made thicker than an outer edge part thereof (see FIG. 13). By firmly pressing the wafer W onto the polishing cloth 102, the wafer W is polished and formed into the concave shape.

Further, if a narrow ring-shaped template 110, which is used for preventing the wafer W so as not to remove from the backing member 108, is adhered on the plate 106 and corresponds to an outer edge of the backing member 108 (see FIG. 14), it is difficult to discharge the excess water existing inside of the template 110.

Unlike the plate 106 having no template, the excess water must be increased in the backing member 108 adhered on the plate 106 having the template 110 shown in FIG. 14.

After the wafer W is polished, the plate 106 is cleaned together with the backing member 108. Therefore, another wafer W to be newly polished is adhered onto the backing member 108 including the excess water.

Namely, the next wafer W is adhered onto the backing member 108 without drying the backing member 108, so it is difficult to adjust water content of the backing member 108 by adjusting amount of supplying water to the backing member 108.

To solve the above described problem, a method of removing excess water of a backing member adhered on a plate is disclosed in Japanese Patent Gazette No. 2003-11056. Namely, water on a holding surface of the backing member, on which the wafer is adhered, is removed by jetting air toward the holding surface of the backing member and/or rotating the plate (please see claims and FIG. 1 of JP 2003-11056).

By jetting air toward the holding surface of the backing member and/or rotating the plate, the water on the backing member can be removed.

However, generally the plate to which the backing member is adhered is cleaned together with the backing member after a wafer is polished, and another wafer is adhered onto the backing member without drying the backing member. Therefore, the backing member still includes the excess water. To remove the excess water by jetting air and/or rotating the plate, several parameters influencing the removal of the excess water, e.g., amount of jetting air, air pressure, a moving speed of an air jet nozzle, a rotational speed of the plate, must be optimized. But, it is difficult to optimize the parameters.

Further, the optimize parameters must be maintained during the polishing, so a control system must be complex.

SUMMARY OF THE INVENTION

An object of the present invention is to provide a method of sucking water and a water sucking device, which are capable of easily removing excess water included in a backing member adhered on a plate of a polishing apparatus.

To achieve the object, the inventors of the present invention studied and found that it is effective to remove the excess water by pressing a water absorbing member onto a holding surface of a backing member, on which a work piece is adhered, and sucking water absorbed by the water absorbing member.

Firstly, the method of the present invention is a method of sucking water, in which excess water, which is used for adhering a work piece to be polished and which is included in a backing member adhered on one side face of a plate of a polishing apparatus, is removed from the backing member, comprising the steps of:

pressing a water absorbing member onto a holding surface of the backing member, on which the work piece is adhered and held, so as to absorb the excess water from the backing member; and sucking the excess water absorbed by the water absorbing member.

On the other hand, the device of the present invention is a water sucking device for sucking excess water, which is used for adhering a work piece to be polished and which is included in a backing member adhered on one side face of a plate of a polishing apparatus, to remove from the backing member, comprising:

a water absorbing member for absorbing the excess water included in the backing member;

means for pressing the water absorbing member onto a holding surface of the backing member; and means for sucking the excess water absorbed by the water absorbing member to remove the excess water therefrom.

In the present invention, the plate may have a ring-shaped template, which corresponds to an outer edge of the holding surface of the backing member so as not to remove the work piece from the holding surface of the backing member.

In the present invention, the backing member may be a porous sponge, and the excess water absorbed by the water absorbing member may be vacuum-sucked. With this structure, the excess water included in the backing member can be easily removed.

In the present invention, a size of the water absorbing member may be equal to that of the holding surface of the backing member so as to press the whole holding surface of the backing member. With this structure, the excess water included in the backing member can be effectively removed.

In the present invention, a holder may be moved to and away from the holding surface of the backing member; a holding member may be attached to the holder so as to hold the water absorbing member, the holding member has a plurality of sucking holes for sucking the excess water absorbed by the water absorbing member; and the holder may be moved toward the holding surface of the backing member until the water absorbing member contacts the holding surface of the backing member, then the water absorbing member may be pressed onto the holding surface of the backing member by weight of the holder and the holding member. With this structure, the water sucking device can be simplified.

In the present invention, the water absorbing member is pressed onto the backing member adhered on the plate, so that the water existing on the holding surface of the backing member and the water absorbed in the backing member can be absorbed by the water absorbing member, further the water absorbed by the water absorbing member can be sucked and removed therefrom.

Therefore, the excess water included in the backing member can be easily removed, so that forming the concave shape of the polished work piece, which is caused by the excess water, can be prevented. Accuracy of polishing the surface of the work piece can be improved.

Further, the parameters influencing the removal of the excess water can be easily optimized, and a control system for maintaining the optimum parameters can be simplified.

BRIEF DESCRIPTION OF THE DRAWINGS

Embodiments of the present invention will now be described by way of examples and with reference to the accompanying drawings, in which.

DETAILED DESCRIPTION OF THE EMBODIMENTS

Preferred embodiments of the present invention will now be described in detail with reference to the accompanying drawings.

Figure 1:
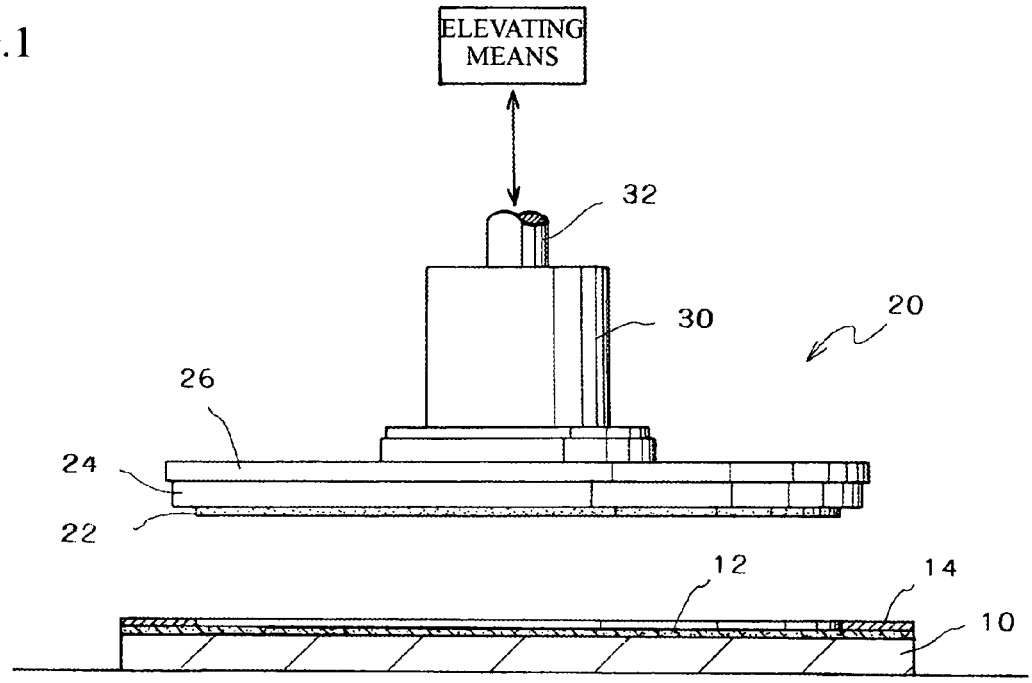
FIG. 1 is a front view of a water sucking device of an embodiment of the present invention.

A water sucking device of an embodiment of the present invention is shown in FIG. 1. In FIG. 1, a backing member 12, which is made of, for example, sheet-shaped resin foam, is adhered on an upper face of a ceramic plate 10. A narrow ring-shaped template 14 is adhered on the plate 10, and the template 14 is provided along an outer edge of the backing member 12, on which a wafer W, which is an example of a work piece, is held.

The water sucking device 20 has a water absorbing member 22, which is made of, for example, a porous sponge and which is capable of covering a whole holding surface of the backing member 12. The wafer W to be polished is held on the holding face of the backing member 12. For example, the water absorbing member 22 may be made of polyvinyl alcohol (PVA).

The water sucking device 20 has a holding plate 24 for holding the water absorbing member 22, and a holder 26, which holds the holding plate 24 and which is moved to and away from the holding surface of the backing member 12. The holder 26 is moved by elevating means, e.g., a cylinder unit.

Figure 2:
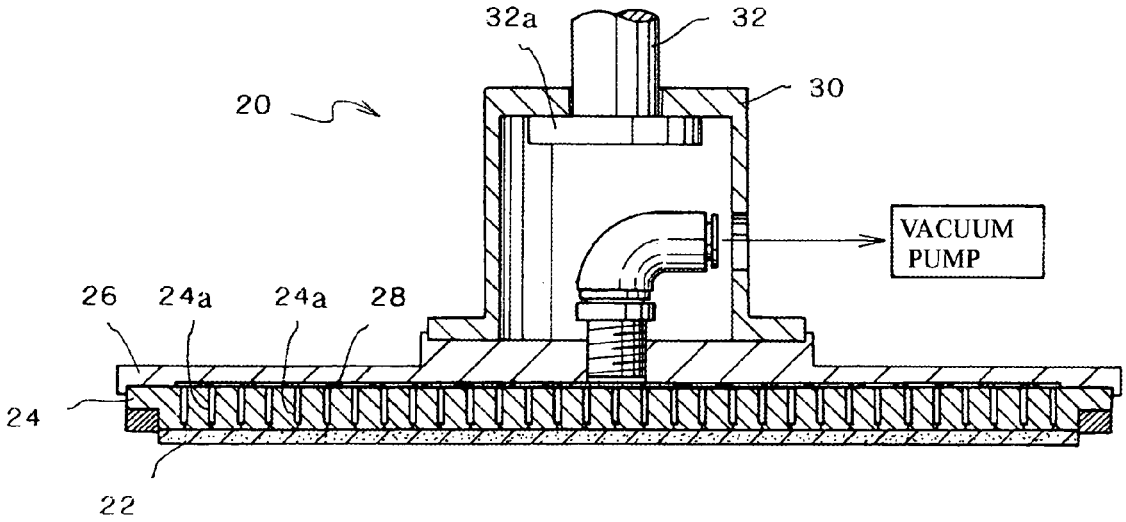
FIG. 2 is a sectional view of the water sucking device shown in FIG. 1.

As shown in FIG. 2, the holding plate 24 has a plurality of sucking holes 24*a*, and air is sucked, through the sucking holes 24*a*, by a vacuum pump. Namely, the water absorbing member 22 is held by the holding plate 24, and water absorbed in the water absorbing member 22 is sucked and removed through the sucking holes 24*a*.

A tube communicating with the vacuum pump is connected to a center part of the holding plate 24. In the water sucking device 20 shown in FIGS. 1 and 2, a distribution plate 28, which is made of rubber, is provided between the holding plate 24 and the holder 26 (see FIGS. 3A and 3B). By using the distribution plate 28, water can be uniformly sucked via the sucking holes 24*a*.

Note that, the distribution plate 28 may be made of other materials, e.g., polyvinyl chloride, stainless steel.

Figure 3A:
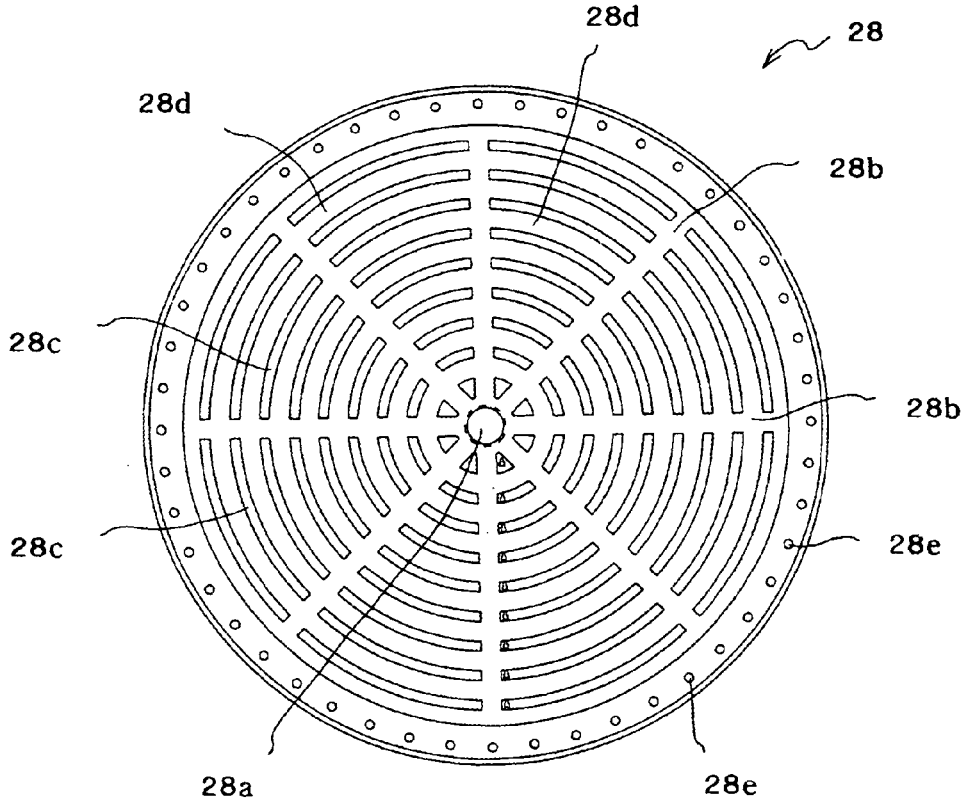
FIG. 3A is a plan view of a distribution plate of the water sucking device.
Figure 3B:
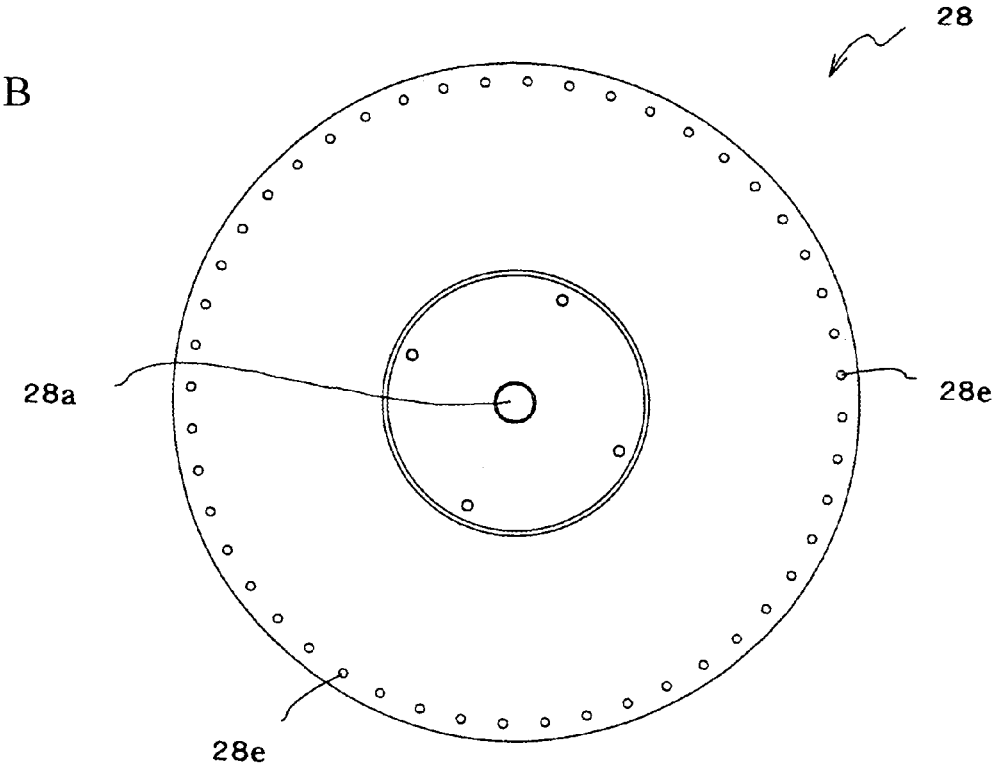
FIG. 3B is a rear view of the distribution plate.

FIG. 3A is a plan view of the distribution plate 28 seen from the holding plate 24 side, and FIG. 3B is a rear view of the distribution plate 28 seen from the holder 26 side.

As shown in FIGS. 3A and 3B, an outlet hole 28*a* is formed at a center part of the distribution plate 28. A plurality of grooves 28*b* are formed in a lower face of the distribution plate 28. The grooves 28*b* are radially extended from the outlet hole 28*a*. Projected lines 28*c* and grooves 28*d* are alternately arranged between the adjacent grooves 28*b*. Further, the projected lines 28*c* and the grooves 28*d* are arranged like concentric circles.

By using the distribution plate 28, air and water sucked through the sucking holes 24*a* of the holding plate 24 are sucked and introduced to the vacuum pump via the grooves 28*b* and 28*d*, the outlet hole 28*a* and the tube connected to the outlet hole 28*a* and the vacuum pump.

With this structure, bypassing from the sucking holes 24*a* to the outlet hole 28*a* can be prevented, so that the air and the water can be uniformly sucked via the sucking holes 24*a*.

Note that, small holes 28*e* are bored in an outer edge part of the distribution plate 28. By sinking screws into the small holes 28*e*, the distribution plate 28 can be attached to the holding plate 24.

In the water sucking device 20 shown in FIGS. 1 and 2, the holding plate 24 and the holder 26 are heavy, so the water absorbing member 22 can be pressed onto the holding surface of the backing member 12 of the plate 10 by weight of the holding plate 24 and the holder 26. A cylindrical section 30 of the holder 26 shown in FIG. 2 is not fixed to a shaft 32 connected to the elevating means. Therefore, the elevating means does not press the absorbing member 22, which contacts the holding surface of the backing member 12 of the plate 10.

Note that, if a flange 32*a* of the shaft 32 contacts a ceiling face of the cylindrical section 30, the water sucking device 20 is vertically moved by the elevating means.

The water sucking device 20 shown in FIGS. 1 and 2 is moved downward by the elevating means. Since the water absorbing member 22 is held by the holding plate 24, the water absorbing member 22 contacts the holding surface of the backing member 12 of the plate 10, which has been mounted on a table, then the water absorbing member 22 is pressed onto the backing member 12 by the weight of the holding plate 24 and the holder 26.

When the absorbing member 22 is pressed, the water absorbing member 22 deforms to correspond to the holding surface of the backing member 12. Therefore, the holding surface of the backing member 12, which is located inside of the template 14, can be pressed.

By pressing the whole holding surface of the backing member 12 with the water absorbing member 22, water stuck on the holding surface of the backing member 12 and water penetrated in the backing member 12 can be absorbed by the water absorbing member 22.

Further, the water absorbed by the water absorbing member 22 is sucked and removed from the absorbing member 22 by the vacuum pump via the sucking holes 24*a* of the holding plate.

After pressing the water absorbing member 22 on the whole holding surface of the backing member 12, which is adhered to the plate 10, for a prescribed time, the water sucking device 20 is moved upward by the elevating means, so that the excess water in the backing member 12 can be completely removed.

Figure 4:
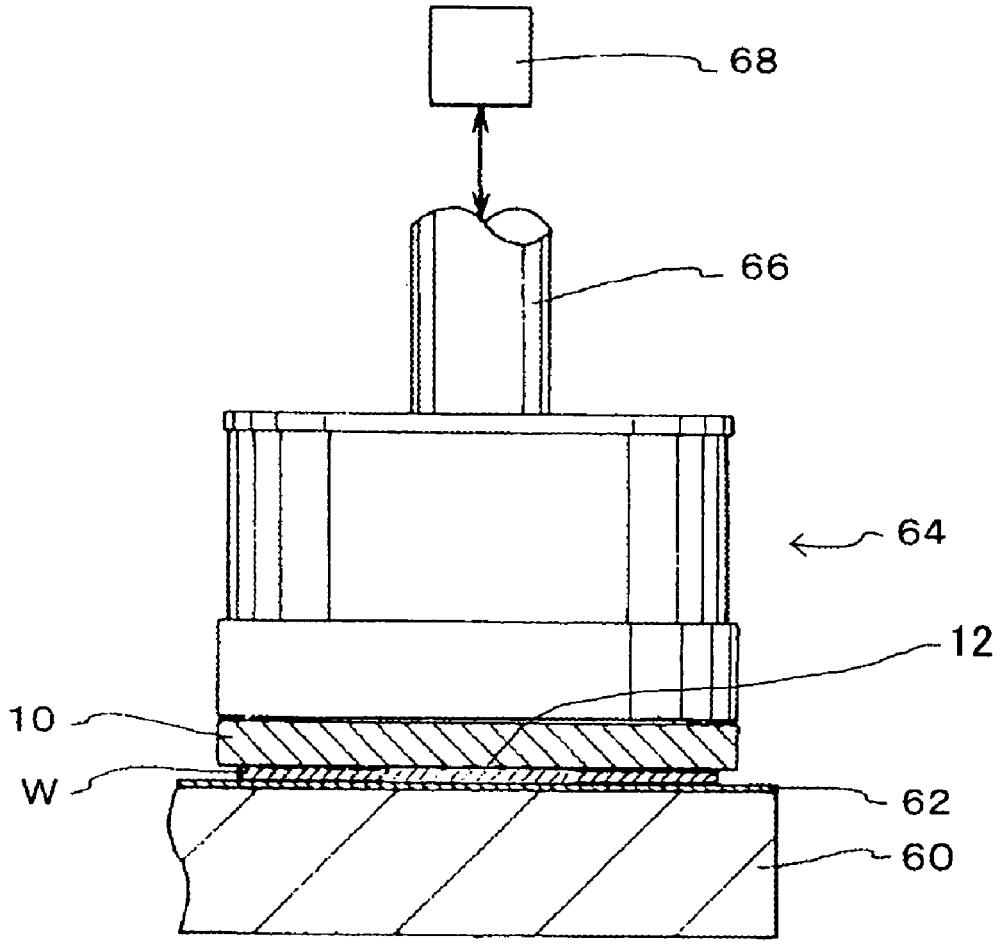
FIG. 4 is a partial sectional view of a polishing apparatus polishing a work piece adhered on a backing member, whose excess water has been sucked by the water sucking device.

The work piece, e.g., the wafer W, is adhered onto the holding surface of the backing member 12, from which the excess water has been removed, by surface tension of water, then the wafer W is polished by a polishing apparatus shown in FIG. 4. In the polishing apparatus shown in FIG. 4, a lower surface of the wafer W is pressed onto a polishing cloth 62 adhered on a polishing plate 60, with the backing member 12 adhered on the lower face of the plate 10, by top ring 64, which contacts the upper face of the plate 10, so that the lower face of the wafer W can be polished.

The top ring 64 is connected to moving means 68 by a shaft 66. With this structure, the top ring 64 can be moved to and away from the upper face of the plate 10.

Figure 5:
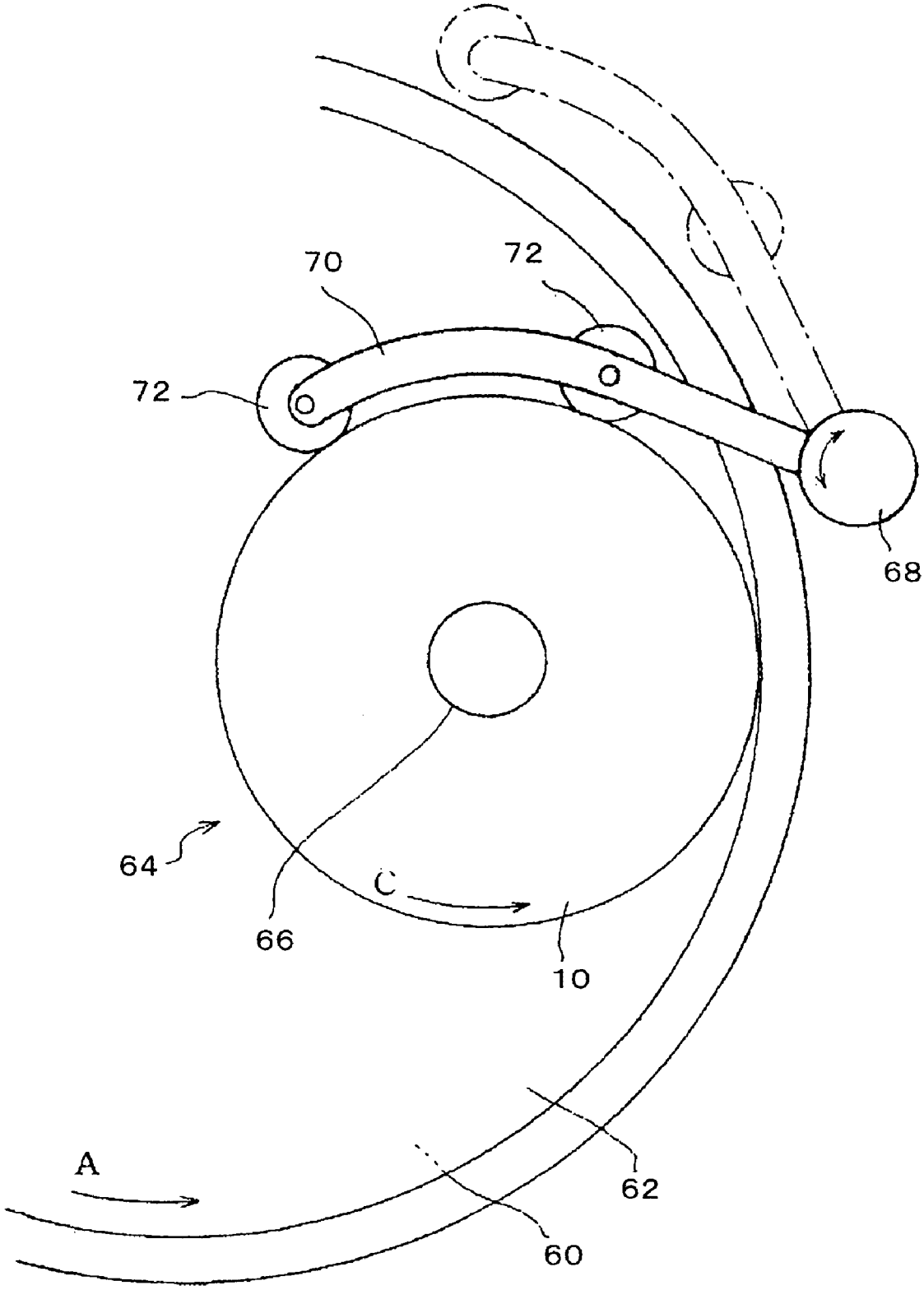
FIG. 5 is a partial plan view of a positioning mechanism for positioning a plate 10 shown in FIG. 4.

The plate 10, to which the wafer W, which is pressed onto the polishing cloth 62 of the polishing plate 60, is adhered, is positioned at a predetermined position in the polishing plate 60 by two rollers 72 (see FIG. 5).

The rollers 72 are attached to an arm 70, whose one end is pivotably attached to a base section located outside of the polishing plate 60 rotating in a direction A. The rollers 72 contact two points of the plate 10, which is rotated in the direction A together with the polishing plate 60.

Note that, when the plate 10 is not positioned at the predetermined position, a pivot shaft 68 of the arm 70 can be turned to move the rollers 72 toward outside of the polishing plate 60.

In FIG. 5, the plate 10 is positioned at the predetermined position by two rollers 72. In another example shown in FIG. 6, the plate 10 can be positioned at the predetermined position in the polishing plate 60 by one roller 72, which is attached to an arm 78 extended the pivot shaft 68 located outside of the polishing plate 60. In this case too, the roller 72 and a center roller 74 contact two points of an outer circumferential face of the plate 10, which is rotated in the direction A together with the polishing plate 60, so that the plate 10 can be positioned at the predetermined position. The center roller 74 is rotated in a direction D.

The inventors performed experiments. Firstly, the excess water included in the backing member 12, which was adhered on the plate 10, was sucked by the water sucking device 20 shown in FIGS. 1 and 2. Then, the wafer W was adhered onto the holding surface of the backing member 12 and polished by the polishing apparatus shown in FIGS. 4 and 5.

The steps of sucking the excess water and polishing the wafer W were repeated several times with the same backing member 12. In each time, thickness (distance from an upper standard surface) was measured at several points in the polished wafer W, and the GBIRs between a maximal value and a minimal value were calculated. The results are shown in FIG. 7A.

Further, the wafer W was similarly polished, but excess water was not removed from the backing member 12. The polishing was repeated several times with the same backing member 12. In each time, thickness (distance from an upper standard surface) was measured at several points in the polished wafer W, and the GBIRs between a maximal value and a minimal value were calculated. The results are shown in FIG. 7B.

Figure 7A:
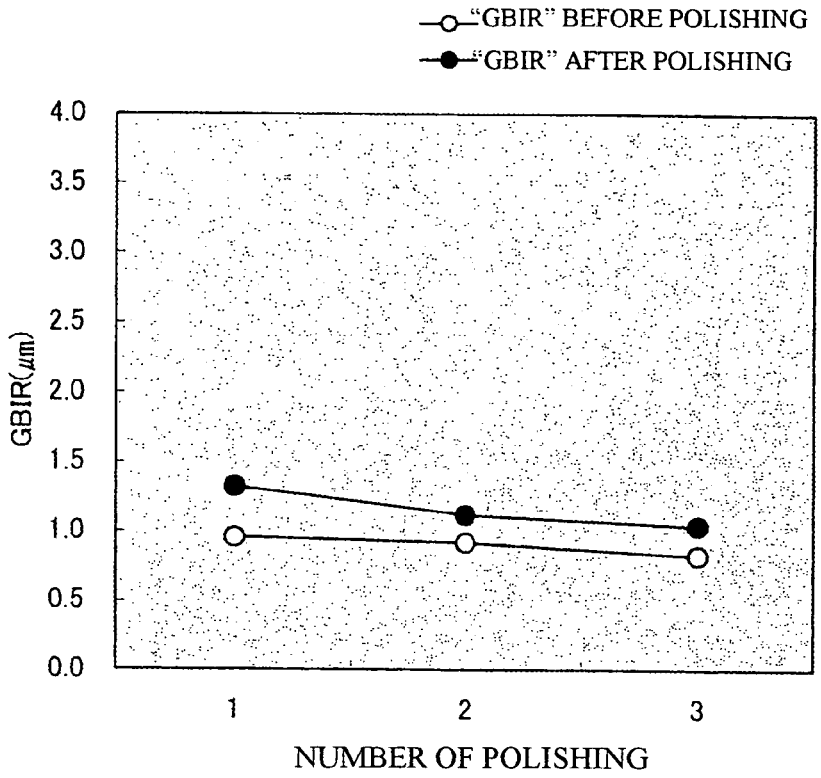
FIGS. 7A and 7B are graphs showing an effect of removing excess water from the backing member.
Figure 7B:
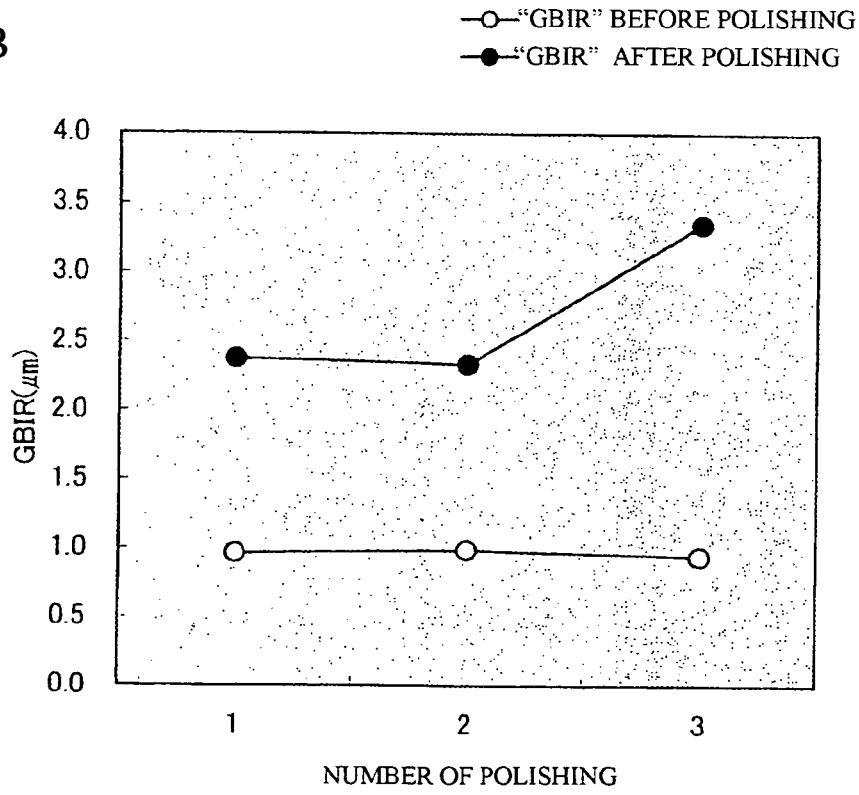

In FIGS. 7A and 7B, horizontal axes indicate number of the polishing; vertical axes indicate the GBIRS.

According to FIGS. 7A and 7B, the flatness of the polished wafer W could be improved by polishing the wafer W after removing the excess water from the backing member 12. Further, the flatness of the polished wafer W could be maintained in spite of repeatedly using the same backing member 12. The reason will be explained.

Figure 13:
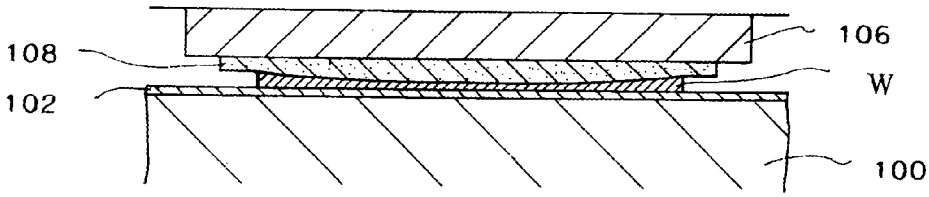
FIG.13 PRIOR ART
FIG. 13 is an explanation view of polishing a wafer W, which is an example of the work piece.
Figure 14:
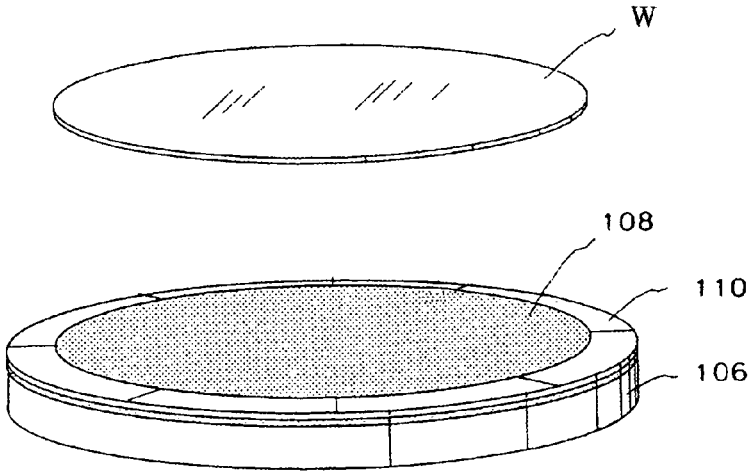
FIG.14 PRIOR ART
FIG. 14 is a perspective view of another plate used in the polishing apparatus shown in FIG. 11.

In the conventional polishing apparatus, as described above with reference to FIG. 13, the excess water concentrates to the center part of the wafer W, so that the center part of the backing member 108 is made thicker than the outer edge part thereof. This phenomenon causes the concave shape of the polished wafer W. On the other hand, in the present invention, the problem can be solved by sucking the excess water included in the backing member 12. Therefore, polishing accuracy can be improved.

In the present embodiment, the water sucking device 20 shown in FIG. 1 can be correctly positioned with respect to the plate 10. Thus, area of the surface of the water absorbing member 22 is equal to that of the holding surface of the backing member 12, which is exposed inside of the template 14.

If it is difficult to correctly position the water sucking device 20 with respect to the plate 10, the surface of the water absorbing member 22 may be broader than the holding surface of the backing member 12, which is exposed inside of the template 14.

In the water sucking device 20 shown in FIGS. 1 and 2, the water absorbing member 22 is pressed onto the holding surface of the backing member 12 of the plate 10 by the weight of the holding plate 24 and the holder 26. If the weight is insufficient, the elevating means, which moves the water sucking device 20 upward and downward, may compulsorily press the water absorbing member 22 onto the backing member 12. In this case, the cylindrical section 30 of the holder 26 (see FIG. 2) is fixed to the shaft 32 connected to the elevating means.

Successively, another embodiment of the water sucking device will be explained with respect to FIGS. 8 and 9. The water sucking device 40 is a roller type water sucking device. The plate 10 is conveyed by a conveyor roller 46. The water sucking device 40 has the water absorbing member 22, which is made of, for example, a porous sponge and which is attached on an outer circumferential face of a rotatable cylindrical member 42.

Figure 9:
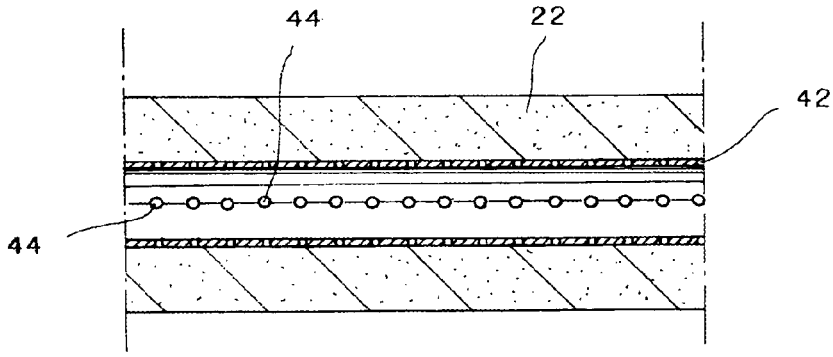
FIG. 9 is a partial sectional view of the water sucking device shown in FIG. 8.

As shown in FIG. 9, the cylindrical member 42 has a plurality of sucking holes 44. By sucking air in the cylindrical member 42 by a vacuum pump, the water absorbing member 22 can be held on the outer circumferential face of the cylindrical member 42, and excess water absorbed in the water absorbing member 22 can be sucked and remove.

The water sucking device 40 is provided above the conveyor roller 46. The water absorbing member 22, which is rotated together with the cylindrical member 42, contacts the holding surface of the backing member 12 of the plate 10, which has been conveyed by the conveyor roller 46. Further, the water absorbing member 22 is pressed onto the holding surface of the backing member 12.

The water stuck on the holding surface of the backing member 12 and water penetrated in the backing member 12 can be absorbed by the water absorbing member 22, and the water absorbed in the water absorbing member 22 is sucked and removed therefrom by the vacuum pump.

Figure 8:
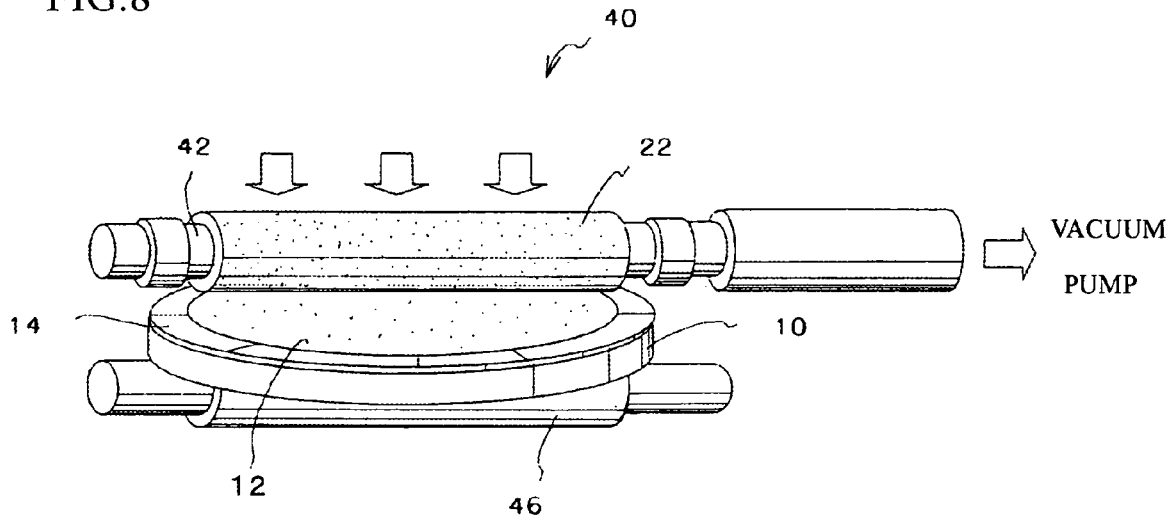
FIG. 8 is a perspective view of a water sucking device of another embodiment of the present invention.

The water sucking device 40 shown in FIG. 8 is fixed at position above the roller conveyor 46. In another case, the water sucking device 40 may be moved along the holding surface of the backing member 12 after the plate 46 is conveyed to and set at a predetermined position. In this case too, the water absorbing member 22 is rotated and pressed onto the holding surface of the backing member 12.

In the water sucking devices shown in FIGS. 1–3 and 8, the water absorbed in the water absorbing members 22 are sucked by the vacuum pumps. Preferably, the vacuum pumps are water ring vacuum pumps, which are capable of sucking water.

Figure 10:
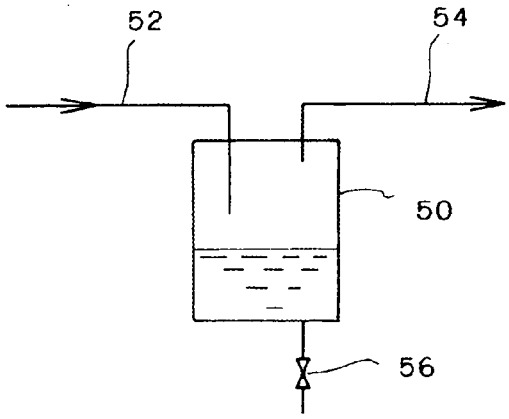
FIG. 10 is a schematic view of a drain separator provided between the water sucking device and a vacuum pump.

In case of using an ordinary vacuum pump, troubles will be occurred by sucked water. To solve this problem, a drain separator shown in FIG. 10 may be provided between the water sucking device and the vacuum pump. The drain separator includes a drain pot 50, which is connected to a tube 52 connected to the water sucking device and a tube 54 connected to the vacuum pump. A purge valve 56 is connected to the drain pot 50 so as to purge water from the drain pot 50.

When an air stream including water, which is sent via the tube 52, enters the drain pot 50, a speed of the air stream is suddenly reduced so that the water is separated from the air and stored in the drain pot 50. Therefore, the air only can be sucked by the vacuum pump via the tube 54.

Figure 6:
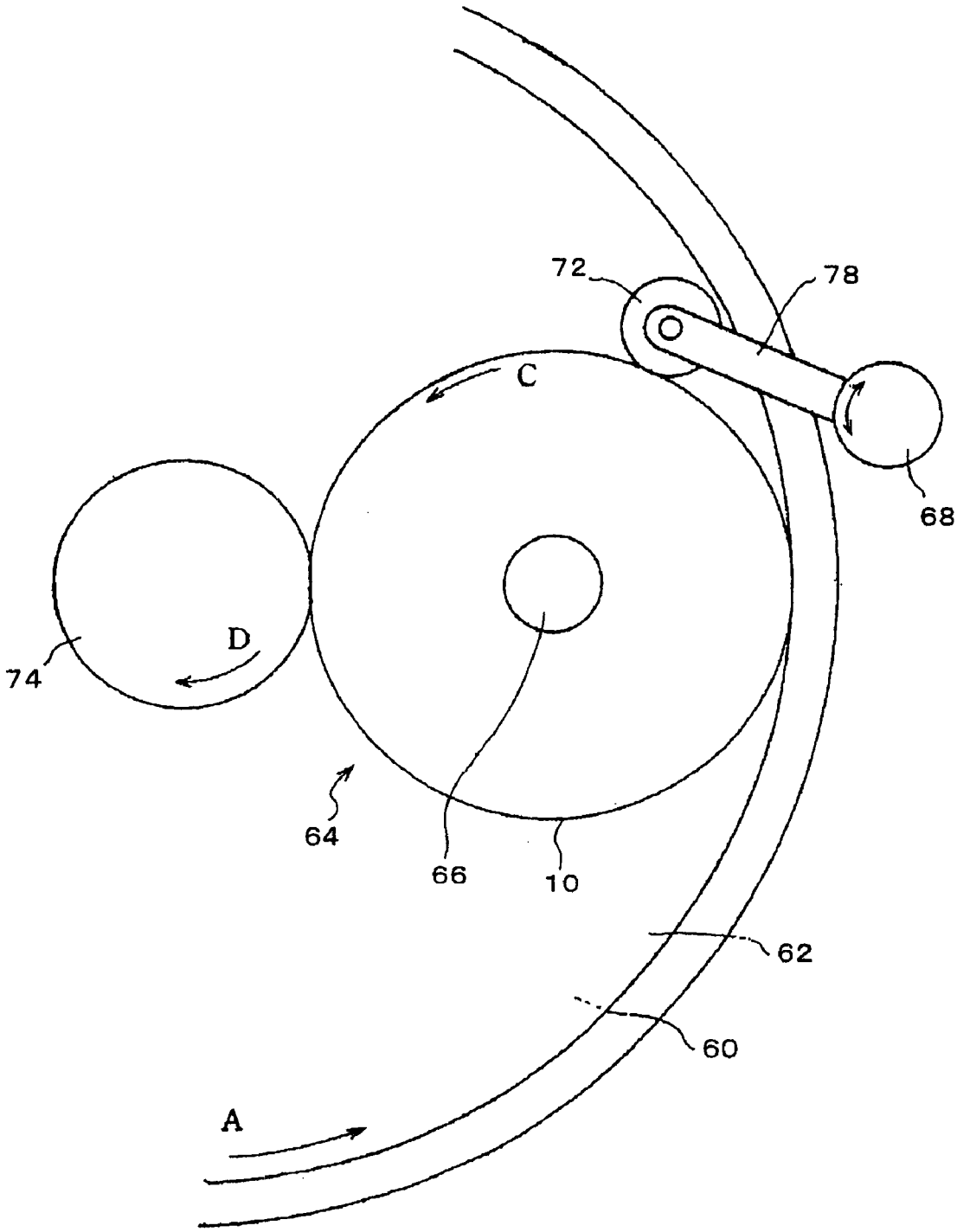
FIG. 6 is a partial plan view of another positioning mechanism for positioning the plate 10 shown in FIG. 4.

As described above, the plate 10 having the backing member 12, from which the excess water has been removed by the water sucking device and the method of the present invention, can be used in the polishing apparatus shown in FIGS. 4–6. In the polishing apparatus, the plate 10 having the backing member 12 is correctly positioned at the predetermined position by the roller or rollers 72. To polish the lower surface of the wafer W, which is adhered on the lower face of the backing member 12 of the plate 10, the wafer W is pressed onto the polishing cloth 62 adhered on the polishing plate 60 by pressing force of the top ring 64.

Figure 11:
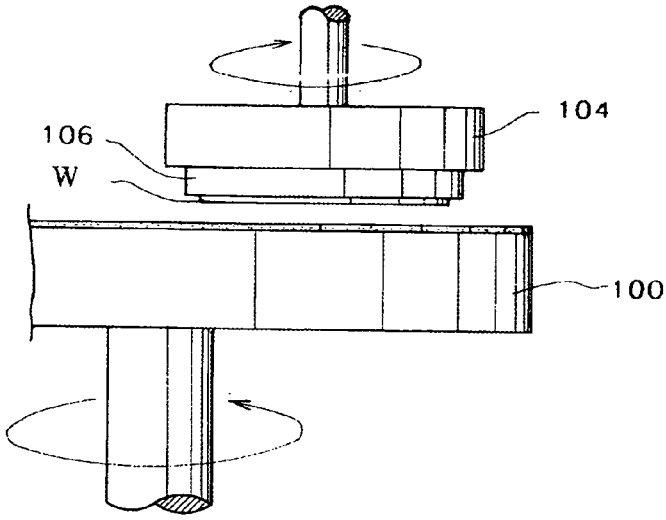
FIG.11 PRIOR ART
FIG. 11 is an explanation view of the conventional polishing apparatus.
Figure 12:
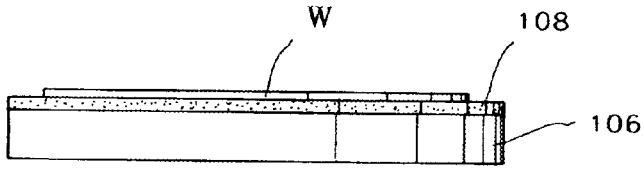
FIG.12 PRIOR ART
FIG. 12 is a front view of the plate used in the polishing apparatus shown in FIG. 11.

The water sucking device and the method of the present invention may be applied to other polishing apparatuses. For example, the present invention may be applied to the polishing apparatus shown in FIG. 11. In the polishing apparatus shown in FIG. 11, the wafer W is held on the ceramic plate 10, which is fixed in the head section of the rotatable top ring 104. The top ring 104 is rotated in a prescribed direction and moved to and away from the polishing cloth 102 adhered on the polishing plate 100. The top ring 104 presses the wafer W onto the polishing cloth 102, so that the lower surface of the wafer W can be polished.

The invention may be embodied in other specific forms without departing from the spirit of essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A method of polishing a wafer, in which the wafer is adhered on a surface of a backing member adhered on one side face of a plate by water and in which a top ring presses the other side face of the plate so as to press the wafer onto a polishing cloth adhered on a polishing plate and rotates the polishing plate so as to polish a surface of the wafer, comprising the step of:

supplying water onto a surface of said backing number;

pressing a water absorbing member onto the surface of said backing member, by pressing means, with sucking excess water, which has been absorbed by the water absorbing member, toward said pressing means so as to remove the excess water; and adhering the wafer onto said backing member after the excess water is removed.

2. The method according to claim 1, wherein said plate has a ring-shaped template, which corresponds to an outer edge of the holding surface of said backing member so as not to remove the work piece from the holding surface of said backing member.

3. The method according to claim 1, wherein said backing member is a porous sponge.

4. The method according to claim 1, wherein the excess water absorbed by said water absorbing member is vacuum-sucked.

5. The method according to claim 1, wherein a size of said water absorbing member is equal to that of the holding surface of said backing member so as to press the whole holding surface of said backing member.

6. The method according to claim 1, wherein a holder is moved to and away from the holding surface of said backing member, a holding member is attached to the holder so as to hold said water absorbing member, the holding member has a plurality of sucking holes for sucking the excess water absorbed by said water absorbing member, and the holder is moved toward the holding surface of said backing member until said water absorbing member contacts the holding surface of said backing member, then the water absorbing member is pressed onto the holding surface of the backing member by weight of the holder and the holding member.

7. A wafer polishing apparatus, in which the wafer is adhered on a surface of a backing member adhered on one side face of a plate by water and in which a top ring presses the other side face of the plate so as to press the wafer onto a polishing cloth adhered on a polishing plate and rotates the polishing plate so as to polish a surface of the wafer, comprising:

a water absorbing member contacting a surface of said backing member and absorbing excess water therein;

means for pressing said water absorbing member onto the surface of said backing member, said pressing means holding said water absorbing member; and means for sucking the excess water, which has been absorbed by said water absorbing member, toward said pressing means so as to remove the excess water.

8. The water sucking device according to claim 7, wherein said plate has a ring-shaped template, which corresponds to an outer edge of the holding surface of said backing member so as not to remove the work piece from the holding surface of said backing member.

9. The water sucking device according to claim 7, wherein said backing member is a porous sponge.

10. The water sucking device according to claim 7, further comprising a holding member for holding said water absorbing member, the holding member having a plurality of sucking holes for vacuum-sucking the excess water absorbed by said water absorbing member held by the holding member.

11. The water sucking device according to claim 7, wherein a size of said water absorbing member is equal to that of the holding surface of said backing member, and said pressing means presses said water absorbing member onto the whole holding surface of said backing member.

12. The water sucking device according to claim 7, wherein said pressing means includes:

a holder being moved to and away from the holding surface of said backing member; and a holding member being attached to the holder so as to hold said water absorbing member, the holding member having a plurality of sucking holes for sucking the excess water absorbed by said water absorbing member, and the holder is moved toward the holding surface of said backing member until said water absorbing member contacts the holding surface of said backing member, then the water absorbing member is pressed onto the holding surface of the backing member by weight of the holder and the holding member.

* * * * *